United States Patent [19]

Voto, Jr. et al.

[11] Patent Number: 4,649,819

[45] Date of Patent: Mar. 17, 1987

[54] ADJUSTABLE SELF-INKING STAMPING DEVICE

[75] Inventors: Leonard M. Voto, Jr., Forest Lake; Richard H. Gillitzer, White Bear Lake, both of Minn.

[73] Assignee: Adjusta-Mounts, Inc., Atlanta, Ga.

[21] Appl. No.: 268,344

[22] Filed: May 29, 1981

[51] Int. Cl.[4] ..... B41F 31/00

[52] U.S. Cl. ..... 101/327

[58] Field of Search ..... 101/327; 403/97

[56] References Cited

U.S. PATENT DOCUMENTS

| | | | |
|---|---|---|---|
| 3,277,601 | 10/1966 | Ryan | 403/97 |
| 4,203,362 | 5/1980 | Underwood et al. | 101/327 |
| 4,304,421 | 12/1981 | Kuhbier | 403/97 |

*Primary Examiner*—Robert A. Hafer
*Assistant Examiner*—Bradley M. Lewis
*Attorney, Agent, or Firm*—Shefte, Pinckney & Sawyer

[57] ABSTRACT

A manually operated self-inking stamping device including a base for contacting material to be stamped, a stamp pad received by the base and having a shaft extending outwardly therethrough, a handle threadedly mounted on the shaft for rotational positioning movement therealong, and a locking member extending between and normally lockingly engaging the handle and the base. A coiled spring is disposed about the shaft between the handle and the locking member to bias the handle and the stamp pad upwardly and to maintain the locking member and the base in engagement. Ordinary operation is achieved by depression of the handle against the biasing of the spring. The engaging surfaces of the locking member and the base are provided respectively with tapered cam teeth configured for normal meshing engagement and for selective relative stepwise indexing movement into and out of meshing engagement upon the application to the handle of a predetermined force for causing rotation thereof, whereby the handle may be adjustably positioned along the shaft to vary its effective length between the handle and the locking member for variance of the exertable stamping pressure.

13 Claims, 6 Drawing Figures

ADJUSTABLE SELF-INKING STAMPING DEVICE

BACKGROUND OF THE INVENTION

The present invention relates to manually-operated self-inking stamping devices of the type having a self-inking stamp pad for impressing any suitable surface with a printed message, design or the like.

Typical prior art stamping devices of the above type utilize a base member for receiving and storing therein the stamp pad and a depressable handle affixed to the stamp pad for effect-contact of the stamp pad with the surface to be stamped, and a biasing arrangement for normally urging the stamp pad upwardly within the base member. The handle may accordingly be depressed against the urging of the biasing arrangement to cause the stamp pad to contact the surface to be stamped. While these devices provide generally satisfactory printing results, they suffer from the disadvantage that the stamping pressure exerted in depressing the handle cannot be uniformly regulated. When the self-inking stamp pad is relatively new, and therefore has an ample supply of ink retained therein, only a light depressing force on the handle is necessary to effect satisfactory printing. However, when the stamp pad has been in use for a considerable length of time, a relatively greater depressing force must be exerted on the handle to achieve comparable printing. The accurate regulation of the depressing force necessary to achieve uniform printing results throughout the useful life of the stamp pad is not possible with such prior art stamping devices.

Other prior art stamping devices of this type have employed various means allowing selective adjustment of the distance which the handle may be depressed thereby facilitating regulation of the stamping pressure exertable upon depression of the handle. One such prior art device is disclosed in U.S. Pat. No. 4,022,127, and employs a two-part bushing disposed below the handle of the stamping device and about a shaft extending from the handle to the stamp pad to act as a stop to restrict vertical depression of the handle, the two bushing parts being threadedly connected so that the length of the entire bushing unit is variable by rotation of the respective bushing parts thereby varying the distance which the handle may be depressed.

Another known prior art device utilizes a cam unit having a sloping cam surface disposed to act as a stop for the handle, the cam unit being either rotatable or slidable to vary the effective height of the cam surface thereby regulating the distance which the handle may be depressed. Such a stamping device is disclosed in U.S. Pat. No. 2,900,902.

In the stamping device of U.S. Pat. No. 4,203,362, the handle is threadedly mounted on a shaft extending from the stamp pad through the base of the device to permit rotational positioning of the handle along the shaft, a movable locking member extending between and engaging the base and the handle in normal operation to maintain the base and handle rigid with respect to each other and to act as a stop for the handle upon depression thereof. To facilitate adjusting positioning of the handle along the shaft, the locking member is initially moved manually to an adjusting disposition disengaged from the base member at which the handle may then be rotated about the shaft to vary the effective length thereof between the handle and the locking member thereby correspondingly varying the distance the handle may be depressed. Thus, in this device, adjustment of the position of the handle on the shaft requires a movement of the locking member along the length of the shaft to disengage the locking member from the base and subsequent rotational movement of the handle while maintaining the locking member disengaged from the base.

SUMMARY OF THE INVENTION

The present invention provides an improvement in adjuustable stamping devices of the above-described type of U.S. Pat. No. 4,203,362. As with such devices, the stamping device of the present invention comprises a base member for contacting material to be stamped, a stamp pad arrangement received by the base member and having a shaft extending outwardly therethrough, a handle mounted on the shaft for selective positioning therealong, and a selectively operable, movable locking member. According to the present invention, the locking member is adapted for normally simultaneously lockingly engaging the handle and the base member for operational stamping movement of the handle and the stamp pad arrangement relative to the base member and for yieldably disengaging from one of the handle and the base member in response to the application to the locking member of a predetermined force for positioning of the handle along the shaft. In this manner, the positioning of the handle along the shaft may be selectively prevented and permitted, respectively, for selectively varying the effective length of the shaft.

In the preferred embodiment of the present invention, the base member has a downwardly open recess therein and a sleeve extending upwardly from and communicating with a hole in the base member, the stamp pad arrangement including a stamp pad backing plate having a self-inking stamp pad affixed to one side thereof and the shaft rigidly affixed to and extending from the other side thereof for vertical movement of the plate relative to the base member within the recess thereof and corresponding movement of the shaft through the hole in the base member. The handle is threadedly mounted on the shaft for movement therewith and for selective rotational positioning movement therealong, and a stop is disposed in the vertical path of movement of the handle for abutment therewith during downward vertical movement thereof. A biasing arrangement is disposed intermediately of the handle and the base member for urging the handle away from the stop and the base member, and for normally biasing the stamp pad arrangement upwardly within the base member.

According to the preferred embodiment, the locking member is disposed about the shaft between the base member and the handle and has a first engaging arrangement at one end thereof for engaging the sleeve of the base member and a second engaging arrangement at the other end thereof for engaging the handle. In such embodiment, the biasing arrangement extends between the handle and the locking member to urge it away from the handle and to bias its first engaging arrangement into engagement with the sleeve of the base member. Thus, the locking member forms the aforementioned stop. The handle and the second engaging arrangement of the locking member are respectively configured and arranged telescopically relative to one another for engagement of the handle by the second engaging arrangement both in normal stamping operation and during positioning of the handle along the shaft. Respective complementarily profiled cam surfaces constituting compatibly-meshing, equilaterally-tapered and spaced teeth are formed about the shaft on the first engaging means and the sleeve of the base member for fitted meshing engagement in ordinary stamping operation and for permitting relative stepwise indexing movement alternately out of and into meshing engagement in response to the application to the handle of a predetermined torsional force for causing rotational movement thereof in either of two opposite directions for selectively increasing or decreasing the effective length of the shaft, the locking member moving telescopically with respect to the handle against the biasing arrangement for disengagement of the first engaging arrangement from the sleeve. To reduce the frictional forces between the first engaging arrangement and the sleeve, the teeth of the first engaging arrangement are truncated and the teeth of the sleeve of the base are substantially V-shaped.

Therefore, it will be appreciated that the handle can be adjustably positioned along the shaft by either moving the locking member longitudinally along the shaft to disengage the locking member from the base and then rotatably positioning the handle in a known manner or by applying the aforesaid predetermined force directly to the handle member.

DESCRIPTION OF THE PREFERRED EMBODIMENT

Figure 1:
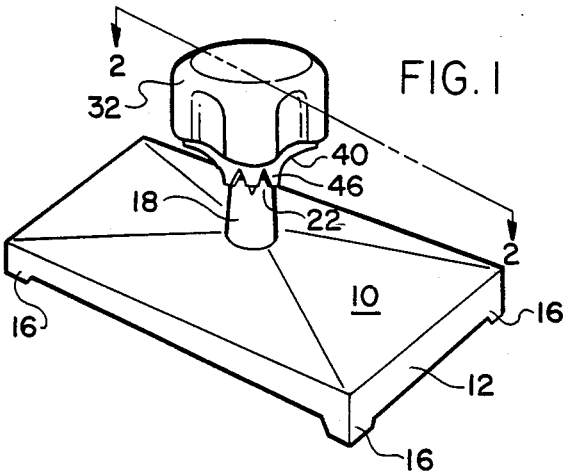
FIG. 1 is a perspective view of a manually-operated self-inking stamping device according to the preferred embodiment of the present invention.

Referring now to the accompanying drawings, a manual self-inking stamping device incorporating the preferred embodiments of the present invention is illustrated perspectively in FIG. 1. The stamping device includes a generally rectangular base member 10 comprising a rectangular housing portion 12 having a downwardly open recess 14 therein and four feet 16, each being located at and extending downward from one corner of the rectangular housing portion 12. The base member 10 also includes a sleeve portion 18 which extends upwardly from the housing portion 12 which is formed with a cylindrical opening 20 therein, the sleeve 18 having a plurality of upwardly projecting teeth 22 equilaterally tapered and spaced circumferentially about the upper edge of the sleeve portion 18.

Figure 2:
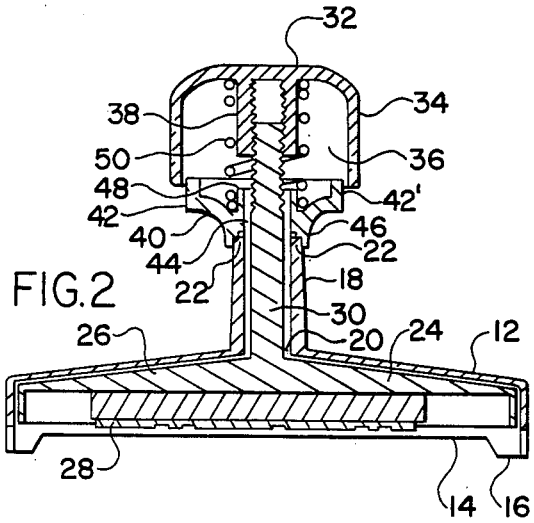
FIG. 2 is a vertical sectional view of the stamping device of FIG. 1 taken along line 2—2 of FIG. 1.

As can best be seen in FIG. 2, a stamping member 24 is provided and includes a backing plate 26 having a self-inking stamp pad 28 affixed to the lower side thereof and a shaft 30 rigidly affixed to and extending upwardly from the upper side thereof. The stamping member 24 is disposed within the recess 14 of the rectangular housing portion 12 with the shaft 30 thereof extending upwardly through the hole 20 and the sleeve portion 18 for relative vertical movement with respect thereto, the backing plate 26 being vertically movable within the recess 14 with the shaft 30 being vertically slidable through the hole 20 and within the sleeve 18. A handle 32 is provided which includes a vertical wall portion 34 forming a downwardly open cavity 36 of generally square shape, and an interiorly threaded sleeve 38 extends downwardly at the center of the handle 32. The extending end of the shaft 30 is threaded for engagement with the threaded sleeve 38 whereby the handle 32 may be rotated about the shaft 30 to selectively position it along the length thereof.

A selectively operable locking member 40 is provided with a central bore 44 that slidably receives the shaft 30, and the locking member 40 includes at the upper end thereof an outwardly flared wall portion 42 having a generally square shape and presenting an exterior surface 42' that is telescopically surrounded in close proximity by the correspondingly square-shaped handle wall portion 34. The locking member 40 is also formed at the lower end thereof with a plurality of downwardly projecting teeth 46 equilaterally tapered and spaced circumferentially about the lower end in correspondence to the teeth 22 of the sleeve portion 18, which teeth 46 normally meshingly engage the teeth 22.

A stop is disposed in the vertical path of movement of the handle 32 for abutment therewith during downward vertical movement thereof, the stop comprising a vertical shoulder 48 formed on the locking member 40 within the square shaped wall portion 42 thereof concentric with the bore 44 for abutment with the sleeve 38 of the handle 32 when the handle 32 is depressed. A coil spring 50 is disposed intermediately of the handle 32 and the locking member 40 for urging the handle 32 away from the shoulder 48 and away from the base 10, thereby normally biasing the stamping member 24 upwardly within the recess 14 of the base 10. The coil spring 50 is disposed about the shaft 30 with the upper end of the spring 50 encircling the sleeve 38 and with the lower end of the spring 50 encircling the shoulder 48 (see FIG. 2). In this manner, the locking member 40 is normally urged by the spring 50 away from the handle 32 to bias the teeth 46 into meshing engagement with the teeth 22.

Figure 3:
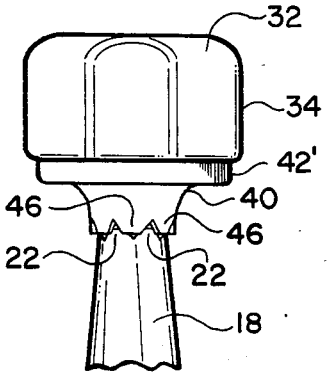
FIG. 3 is a detailed side elevational view of the locking member of the stamping device of FIG. 1 in its normal operational mode.

The stamping device of the present invention is normally maintained in the disposition shown in FIGS. 1, 2 and 3 with the spring 50 acting between the handle 32 and the locking member 40 to urge the handle 32, the shaft 30 and the stamping member 24 upwardly, and to urge the locking member 40 downwardly against the base sleeve 18. In this operating or locking mode of the locking member 40, it will be noted that the locking member 40 is held against rotation because of the meshing engagement between the teeth 46 and the teeth 22 (FIG. 3) and the handle 32 is likewise held against rotation about the shaft 30 because the square wall portion 34 of the handle 32 telescopically surrounds the square wall portion 42 of the non-rotating locking member 40. Therefore, the handle 32 is locked against adjusting rotation along the shaft 30. In the preferred embodiment of the present invention, the handle wall portion 34 and the locking member wall portion 42 have generally square configurations; however, other straight-sided configurations (e.g. triangular shapes) could also be used without departing from the scope of the invention.

To operate the stamping device of the present invention, the base 10 is positioned with the feet 16 thereof in contact with the material to be stamped (not shown) and the handle 32 is vertically depressed against the biasing force of the spring 50 to cause downward vertical movement of the shaft 30 and the stamping member 24, thereby causing the stamp pad 28 to be pressed into stamping contact with the material to be stamped, the shoulder 48 of the locking member 40 acting as a stop to restrict the vertical depression of the handle 32.

Figure 4:
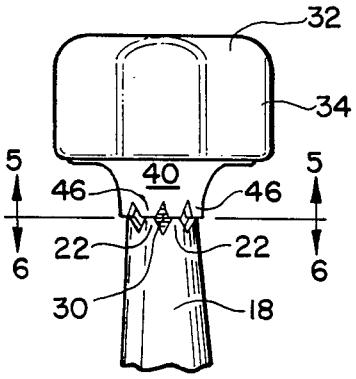
FIG. 4 is a detailed side elevational view of the locking member of the stamping device of FIG. 1 similar to FIG. 3, illustrating it in yielding disengagement from the sleeve of the base member of the stamping device.
Figure 5:
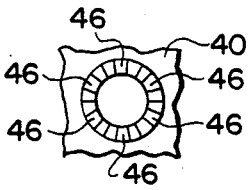
FIG. 5 is a horizontal sectional view of the locking member of the stamping device of FIG. 1 taken along line 5—5 of FIG. 4.
Figure 6:
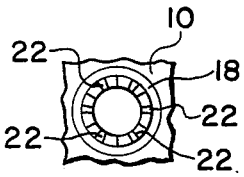
FIG. 6 is a horizontal sectional view of the sleeve of the base member of the stamping device of FIG. 1 taken along line 6—6 of FIG. 4.

As the stamping device is used and the ink stored within the stamp pad 28 is gradually expended, it will become necessary to exert proportionately greater stamping pressure against the material to be stamped in order to achieve satisfactory printing results. To facilitate the required increase in stamping pressure, the respective teeth 22 and 46 of the sleeve portion 18 of the base member 10 and the lower end of the movable locking member 40 are taperingly configured and spaced as described above to act as complementarily-profiled cam surfaces which permit yielding disengagement of the teeth 22, 46 from their normal meshing disposition in response to the application to the handle 32 and thereby to the locking member 40 of a predetermined torsional force for causing rotation of the handle 32 about the shaft 30 sufficient to overcome the biasing force of the spring 50 urging the teeth 22, 46 into engagement to cause the movable member 40 to cammingly move telescopically upwardly within the cavity 36 of the handle 32 (FIG. 4). In this manner, the handle 32 and the locking member 40 may be rotated about the shaft as a unit to relatively index the teeth 22, 46 stepwise into and out of meshing engagement with one another to thereby selectively increase the effective length of the shaft 30 between the handle 32 and the shoulder 48, thereby increasing the distance the handle 32 may be moved vertically downwardly in ordinary stamping operation before the sleeve 38 thereof abuts the shoulder 48 of the locking member 40 and correspondingly increasing the stamping pressure which may be exerted against the material to be stamped. As will be understood, the equilateral tapering and spacing of the teeth 22, 46 permits selective rotation of the handle 32 and the locking member 40 in the opposite direction to index the teeth 22, 46 stepwise to decrease the effective length of the shaft 30, thereby to decrease the exertable stamping pressure. As can best be seen in FIGS. 3–6, the teeth 46 of the locking member 40 are truncated and the teeth 22 of the sleeve 18 are substantially V-shaped to reduce the surface areas of the teeth 22, 46 which are in contact in their normal meshing disposition of FIG. 3 to thereby reduce the frictional forces therebetween for enhancement of the above-described indexing movement of the teeth 22, 46.

It will therefore be appreciated that the stamping device of the present invention provides a significant improvement over conventional stamping devices in providing versatility to and simplification of the adjusting operation. Thus, the adjustment of the stamping device of the present invention may be effected if desired in the known manner of manually disengaging the movable member 40 from the base member 10 and then rotating the handle 32 or may be performed simply in one step by exerting on the handle 32 a sufficient rotational force to actuate the above-described indexing movement without any initial manual manipulation of the movable member. As will be appreciated, either adjusting operation can be affected by the user with only one hand. Additionally, the stamping device has a simple construction which may be economically reproduced, and all parts excepting the conventional spring 50 and the conventional stamping member 24 may be molded from plastic and assembled without special tools.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. A manually-operated self-inking stamping device comprising:

(a) base means for contacting material to be stamped, (b) stamp pad means received by said base means and having a shaft extending outwardly through said base means, (c) handle means mounted on said shaft for selective positioning therealong, said handle means being rotatable for a full 360 degrees with respect to said base means about said shaft, and (d) locking means adapted for normally simultaneously lockingly engaging said handle means and said base means for operational stamping movement of said handle means and said stamp pad means relative to said base means and for yieldably disengaging from one of said handle means and said base means solely in response to the application to said locking means of a predetermined torsional force applied in a direction about said shaft for positioning said handle means along said shaft thereby to selectively prevent and permit, respectively, said positioning of said handle means along said shaft for selectively varying the effective length thereof.

2. A manually-operated self-inking stamping device according to claim 1 and characterized further in that said locking means and said one of said handle means and said base means include respective complementarily-profiled cam surfaces cooperatively adapted for fitted engagement and for permitting yielding disengagement upon application to said locking means of said predetermined force.

3. A manually-operated self-inking stamping device according to claim 2 and characterized further in that said cam surfaces include compatibly meshing projections adapted for relative stepwise indexing movement alternately out of and into meshing engagement in response to said predetermined force.

4. A manually-operated self-inking stamping device according to claim 3 and characterized further in that said projections comprise equilaterally tapered and spaced teeth for selective relative indexing movement thereof in either of two opposite directions for selectively increasing or decreasing said effective length of said shaft in respective response to the application of said predetermined force to said locking means in opposite directions.

5. A manually-operated self-inking stamping device according to claim 3 and characterized further in that said handle means is threadedly mounted on said shaft for rotation about said shaft to selectively position said handle means therealong and in that said cam surfaces surround said shaft for yielding indexing movement in response to the application to said handle means of a predetermined force for causing rotational movement thereof.

6. A manual self-inking stamping device according to claims 1, 4 or 5 and characterized further in that said locking means comprises a movable member disposed about said shaft between said base means and said handle means and having first engaging means for engaging said base means and second engaging means for engaging said handle means, one of said handle means or said base means and the corresponding engaging means of said locking means including said cam surfaces.

7. A manually-operated self-inking stamping device according to claim 6 and characterized further by biasing means disposed intermediately of said handle means and said movable member for urging said handle means away from said base means to normally bias said stamp pad means into receipt by said base means and for urging said movable member away from said handle means to bias said first engaging means into engagement with said base means, said second engaging means of said movable member and said handle means being respectively configured and arranged telescopically relative to one another for engagement of said handle means by said second engaging means both in said normal stamping operation and during said positioning of said handle means, and said cam surfaces being formed on said first engaging means and said base means for movement of said movable member telescopically with respect to said handle means against the biasing force of said biasing means to disengage said first engaging means from said base means upon the application to said handle means of said predetermined force of positioning movement.

8. A manually-operated self-inking stamping device according to claim 7 and characterized further in that said cam surfaces include equilaterally tapered and spaced teeth for relative stepwise indexing movement alternately out of and into meshing engagement in either of two opposite directions for selectively increasing or decreasing said effective length of said shaft respectively in response to the application of said predetermined force to said handle means in opposite directions, the teeth of said cam surface of said first engaging means of said movable member being truncated and the teeth of said cam surface of said base means being substantially V-shaped to reduce the frictional forces therebetween to enhance said indexing movement in response to said predetermined force.

9. A manually-operated self-inking stamping device comprising:

(a) base means for contacting material to be stamped, (b) stamp pad means disposed within said base means for relative vertical movement with respect thereto, said stamp pad means having a shaft fixed thereto and extending outwardly through said base means, (c) handle means mounted on said shaft for vertical movement therewith, said handle means being selectively positionable along the length of said shaft and being rotatable for a full 360 degrees with respect to said base means about said shaft;

(d) stop means disposed in the vertical path of movement of said handle means for abutment therewith during downward vertical movement thereof, (e) biasing means disposed intermediately of said handle means and said base means for urging said handle means away from said stop means and said base means, and for normally biasing said stamp pad means upwardly within said base means, and (f) selectively operable locking means adapted for disposition in a normal operating mode simultaneously lockingly engaging said handle means and said base means to retain said handle means against said positioning movement thereof along said shaft, whereby said handle means may be depressed against the biasing force of said biasing means to cause said stamp pad means to contact the material to be stamped, and being yieldably disengagable from at least one of said handle means and said base means solely in response to the application to said locking means of a predetermined torsional force applied in a direction about said shaft for selective adjusting positioning of said handle means along said shaft to vary the effective length of said shaft between said handle means and said stop means thereby to vary the distance said handle means may be moved vertically downwardly before abutting said stop means so that the resulting stamping pressure exerted against the material to be stamped is correspondingly varied.

10. A manually-operated self-inking stamping device according to claim 9 and characterized further in that said locking means and said one of said handle means and said base means include respective sets of complementarily-profiled cam teeth equilaterally tapered and spaced for normal meshing engagement and for selective relative indexing movement into and out of said meshing engagement in either of two opposite directions for selectively increasing or decreasing said effective length of said shaft in respective response to the application of said predetermined force to said locking means in opposite directions.

11. A manually-operated self-inking stamping device according to claim 10 and characterized further in that said handle means is threadedly mounted on said shaft for rotation about said shaft to selectively position said handle means therealong and in that said cam surfaces surround said shaft for yielding indexing movement in response to the application to said handle means of a predetermined force for causing rotational movement thereof.

12. A manually-operated self-inking stamping device according to claim 11 and characterized further in that said locking means comprises a movable member disposed about said shaft between said base means and said handle means and having first engaging means at one end thereof for engaging said base means, said first engaging means and said base means having formed thereon said cam teeth, and having second engaging means at the opposite end thereof for engaging said handle means, said second engaging means and said handle means being respectively configured and arranged telescopically relative to one another for engagement both in said normal operating mode and during said positioning of said handle means, said biasing means being arranged to extend between said handle means and said movable member to urge said movable member away from said handle means for biasing said first engaging means into engagement with said base means, whereby, upon rotation of said handle means, said movable member moves telescopically with respect to said handle means to disengage said first engaging means from said base means.

13. A manually-operated self-inking stamping device comprising:

(a) a base for contacting material to be stamped, said base having a downwardly open recess therein and a sleeve extending upwardly from and communicating with a hole in said base, said sleeve having a plurality of teeth spaced about the upper edge thereof, (b) a stamp pad backing plate having a self-inking stamp pad affixed to one side thereof and a shaft rigidly affixed to and extending from the other side thereof, said plate being vertically movable within said recess with said shaft being vertically slidable through said hole in said base, (c) a movable member formed with a bore extending therethrough to slidably receive said shaft, said movable member having a plurality of teeth disposed at one end thereof for selective meshing engagement with said teeth on said base, (d) a depressable handle threadedly engaging said shaft for selective movement therealong, said handle having a downwardly open cavity closely encircling said movable member to resist rotational movement of said handle about said shaft when said movable member teeth are in meshing engagement with said teeth of said sleeve, and (e) biasing means disposed intermediately of said movable member and said handle for urging said movable member away from said handle and urging said movable member teeth into meshing engagement with said teeth of said sleeve thereby normally biasing said stamp pad backing plate upwardly within said recess of said base, whereby said handle may be vertically depressed against the biasing force of said biasing means to cause said stamp pad to be pressed into stamping contact with material to be stamped, said movable member acting as a stop to restrict the vertical depression of said handle, and said movable member teeth and said teeth of said sleeve being complementarily profiled to form cam surfaces adapted for relative stepwise indexing movement alternately out of and into meshing engagement upon the application to said handle of a predetermined torsional force for rotational movement thereof, whereby said movable member may be cammingly moved upwardly within said cavity of said handle against the biasing force of said biasing means to disengage said movable member teeth from said teeth of said sleeve so that said handle may be indexably rotated about said shaft to selectively vary the effective length of said shaft between said handle and said movable member and thereby vary the distance said handle may be depressed before it is stopped by said movable member so that the stamping pressure which may be exerted against the material to be stamped is correspondingly varied.

* * * * *